US011227541B2

(12) United States Patent
Song

(10) Patent No.: US 11,227,541 B2
(45) Date of Patent: Jan. 18, 2022

(54) IMAGE DISPLAY DRIVE DEVICE, DISPLAY DEVICE AND ELECTRICAL COMPENSATION METHOD

(71) Applicant: BOE TECHNOLOGY GROUP CO., LTD., Beijing (CN)

(72) Inventor: Chen Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 767 days.

(21) Appl. No.: 16/073,988

(22) PCT Filed: Jan. 4, 2018

(86) PCT No.: PCT/CN2018/071374
§ 371 (c)(1),
(2) Date: Jul. 30, 2018

(87) PCT Pub. No.: WO2018/223693
PCT Pub. Date: Dec. 13, 2018

(65) Prior Publication Data

US 2021/0210006 A1 Jul. 8, 2021

(30) Foreign Application Priority Data

Jun. 7, 2017 (CN) ..... 201710422374.6

(51) Int. Cl.
*G09G 3/3208* (2016.01)

(52) U.S. Cl.
CPC ..... *G09G 3/3208* (2013.01); *G09G 2310/08* (2013.01); *G09G 2320/0228* (2013.01); *G09G 2320/0693* (2013.01)

(58) Field of Classification Search
CPC ..... G09G 3/3208; G09G 2310/08; G09G 2320/0228; G09G 2320/0693
See application file for complete search history.

(56) References Cited

U.S. PATENT DOCUMENTS

| | | | |
|---|---|---|---|
| 7,952,379 | B2 | 5/2011 | Kwak |
| 9,041,633 | B2 | 5/2015 | Park et al. |
| 10,304,391 | B2 | 5/2019 | Ge et al. |

(Continued)

FOREIGN PATENT DOCUMENTS

| | | | |
|---|---|---|---|
| CN | 101226712 | A | 7/2008 |
| CN | 102768821 | A | 11/2012 |

(Continued)

OTHER PUBLICATIONS

Chinese Office Action in Chinese Application No. 201710422374.6, dated Dec. 17, 2019 with English translation.

(Continued)

*Primary Examiner* — Stephen G Sherman
(74) *Attorney, Agent, or Firm* — Collard & Roe, P.C.

(57) ABSTRACT

An image display drive device, a display device and an electrical compensation method are disclosed. The image display drive device includes a detection circuit and a data superposition circuit. The detection circuit is configured to obtain an electrical compensation data signal of a display panel; the data superposition circuit is configured to superpose the electrical compensation data signal and the initial driving data signal, so as to obtain a compensated driving data signal.

17 Claims, 6 Drawing Sheets

(56) References Cited

U.S. PATENT DOCUMENTS

| | | | | |
|---|---|---|---|---|
| 10,522,084 | B2 * | 12/2019 | Zhang | G09G 3/3233 |
| 2006/0007249 | A1 * | 1/2006 | Reddy | G06F 3/0412 345/690 |
| 2012/0056869 | A1 | 3/2012 | Cha et al. | |
| 2015/0042694 | A1 | 2/2015 | Lee et al. | |
| 2015/0187278 | A1 | 7/2015 | Park | |
| 2016/0063910 | A1 | 3/2016 | An | |

FOREIGN PATENT DOCUMENTS

| | | | |
|---|---|---|---|
| CN | 104025177 | A | 9/2014 |
| CN | 104464627 | A | 3/2015 |
| CN | 104637447 | A | 5/2015 |
| CN | 104751771 | A | 7/2015 |
| CN | 104751793 | A | 7/2015 |
| CN | 105023539 | A | 11/2015 |
| CN | 105390084 | A | 3/2016 |
| CN | 107068049 | A | 8/2017 |
| TW | 201028031 | A | 7/2010 |

OTHER PUBLICATIONS

International Search Report of PCT/CN2018/071374 in Chinese, dated Mar. 30, 2018 with English translation.
Notice of Transmittal of the International Search Report of PCT/CN2018/071374 in Chinese, dated Mar. 30, 2018.
Written Opinion of the International Searching Authority of PCT/CN2018/071374 in Chinese, dated Mar. 30, 2018 with English translation.
Chinese Office Action in Chinese Application No. 201710422374.6, dated Nov. 28, 2018 with English translation.

* cited by examiner

IMAGE DISPLAY DRIVE DEVICE, DISPLAY DEVICE AND ELECTRICAL COMPENSATION METHOD

CROSS REFERENCE TO RELATED APPLICATIONS

This application is the National Stage of PCT/CN2018/071374 filed on Jan. 4, 2018, which claims priority under 35 U.S.C. § 119 of Chinese Application No. 201710422374.6 filed on Jun. 7, 2017, the disclosure of which is incorporated by reference.

TECHNICAL FIELD

Embodiments of the present disclosure relate to an image display drive device, a display device and an electrical compensation method.

BACKGROUND

Organic Light Emitting Diode (OLED) display panels have gradually attracted the attention of people due to advantages such as wide viewing angle, high contrast, fast response, and higher luminance, lower driving voltage and the like compared with inorganic light emitting diode display devices. Because of the above-mentioned characteristics, the organic light emitting diode (OLED) display panels can be applied into mobile phones, displays, laptops, digital cameras, instruments, and devices with display functions. However, OLED display panels have issues of inhomogeneous display brightness. Generally, electrical compensation methods or optical compensation methods can be adopted to improve the uniformity of the display brightness of OLED display panels.

SUMMARY

An embodiment of the present disclosure provides an image display drive device, and the image display drive device includes a detection circuit and a data superposition circuit. The detection circuit is configured to obtain an electrical compensation data signal of a display panel; the data superposition circuit is configured to superpose the electrical compensation data signal and an initial driving data signal so as to obtain a compensated driving data signal.

For example, in the image display drive device provided by an embodiment of the present disclosure, the detection circuit is configured to obtain a calibration base electrical signal and a detection electrical signal of the display panel and to obtain the electrical compensation data signal of the display panel based on the calibration base electrical signal and the detection electrical signal.

For example, in the image display drive device provided by an embodiment of the present disclosure, the detection circuit includes a voltage sampling circuit or a current sampling circuit.

For example, in the image display drive device provided by an embodiment of the present disclosure, the drive device further includes a storage circuit. The storage circuit is configured to store at least one of the calibration base electrical signal and the detection electrical signal, and to provide the at least one of the calibration base electrical signal and the detection electrical signal to the data superposition circuit.

For example, in the image display drive device provided by an embodiment of the present disclosure, the storage circuit includes a register.

For example, in the image display drive device provided by an embodiment of the present disclosure, the detection circuit further includes an analog-to-digital conversion circuit; and the analog-to-digital conversion circuit is configured to convert an analog signal obtained by the detection circuit into a digital signal.

For example, in the image display drive device provided by an embodiment of the present disclosure, the drive device further includes a data bit conversion circuit. The data bit conversion circuit is configured to convert a data bit length of the calibration base electrical signal and a data bit length of the detection electrical signal to match a data bit length of the initial driving data signal.

For example, in the image display drive device provided by an embodiment of the present disclosure, the drive device further includes a data driving circuit. The data driving circuit is configured to convert the compensated driving data signal of the display panel into an analog signal suitable to drive the display panel.

Another embodiment of the present disclosure provides a display device, and the display device includes the above-mentioned drive device and a display panel electrically connected to the drive device. The electrical compensation data signal of the display panel is configured to be detectable.

For example, in the display device provided by another embodiment of the present disclosure, the display device further includes a calibration source and a timing control circuit. The calibration source is configured to be electrically connected to the drive device, and to provide a calibration base electrical signal to the drive device provided that the detection circuit is further configured to obtain the calibration base electrical signal; the timing control circuit is configured to provide the initial driving data signal of the display panel to the drive device.

For example, in the display device provided by another embodiment of the present disclosure, the calibration source includes a constant voltage source or a constant current source.

Further another embodiment of the present disclosure provides an electrical compensation method, the electrical compensation method includes: obtaining an electrical compensation data signal of a display panel; and superposing the electrical compensation data signal and an initial driving data signal so as to obtain a compensated driving data signal.

For example, in the electrical compensation method provided by further another embodiment of the present disclosure, obtaining a calibration base electrical signal and a detection electrical signal of the display panel, and obtaining the electrical compensation data signal of the display panel based on the calibration base electrical signal and the detection electrical signal.

For example, in the electrical compensation method provided by further another embodiment of the present disclosure, the electrical compensation method further includes: storing at least one of the calibration base electrical signal and the detection electrical signal, and accessing the at least one of the calibration base electrical signal and the detection electrical signal when superposing the electrical compensation data signal and the initial driving data signal.

For example, in the electrical compensation method provided by further another embodiment of the present disclosure, the electrical compensation method further includes: converting the calibration base electrical signal and the detection electrical signal into digital signals, and obtaining the compensated driving data signal through superposing the electrical compensation data signal, which is obtained based on the calibration base electrical signal and the detection electrical signal, and the initial driving data signal.

BRIEF DESCRIPTION OF THE DRAWINGS

In order to clearly illustrate the technical solution of the embodiments of the disclosure, the drawings used in the description of the embodiments or relevant technologies will be briefly described in the following; it is obvious that the described drawings are only related to some embodiments of the disclosure and thus are not limitative of the disclosure.

DETAILED DESCRIPTION

Figure 1:
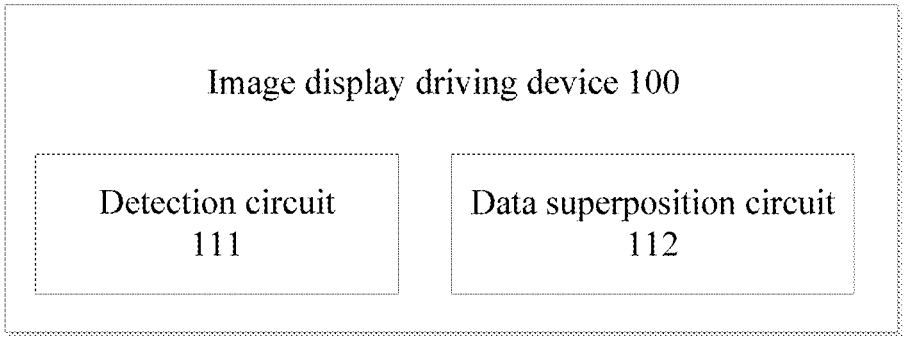
FIG. 1 is an exemplary block diagram of an image display drive device provided by a first embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The inventor notes that the following electrical compensation method can be adopted to improve the display brightness uniformity of an organic light emitting diode display panel. Firstly, a sampling process is conducted with respect to an electrical signal outputted by a display panel through an image display drive device (for example, a drive chip) that is used for driving the display panel; then, an electrical sampling data obtained by the drive chip is provided to a timing control circuit (i.e., a T-CON circuit); next, the timing control circuit superposes the electrical sampling data and an initial driving data based on a specific compensation algorithm, so as to obtain a driving data after compensation; lastly, the timing control circuit provides the driving data after compensation to the display panel, and therefore, the display brightness uniformity of the display panel can be improved.

However, the inventor further notes that, it is necessary to adopt the timing control circuit in compensation processes when performing electrical compensations with the above-mentioned method, and issues such as designing of compensation algorithms performed in the timing control circuit, reading of sampling data, and superposition of sampling data are also involved. All these decrease the system integration level and lower the response speed.

At least one embodiment of the present disclosure provides an image display drive device, a display device and an electrical compensation method, and the system integration level and the response speed can be improved.

At least one embodiment of the present disclosure provides an image display drive device, and the image display drive device includes a detection circuit and a data superposition circuit. The detection circuit is configured to obtain an electrical compensation data signal of a display panel; the data superposition circuit is configured to superpose the electrical compensation data signal and an initial driving data signal so as to obtain a compensated driving data signal.

At least one embodiment of the present disclosure further provides a display device, and the display device includes the above-mentioned drive device and a display panel electrically connected to the drive device. The display panel is configured to be able to detect electrical compensation data signal.

At least one embodiment of the present disclosure further provides an electrical compensation method, the electrical compensation method includes: obtaining an electrical compensation data signal of a display panel; and superposing the electrical compensation data signal and an initial driving data signal so as to obtain a compensated driving data signal.

An image display drive device and method according to the embodiment of the present disclosure are described in the following with reference to a plurality of embodiments.

First Embodiment

The present embodiment provides an image display drive device 100, and the image display drive device 100, for example, can be implemented as a drive chip to drive a display panel. For example, FIG. 1 illustrates an exemplary block diagram of an image display drive device 100 provided by the first embodiment of the present disclosure; as illustrated in FIG. 1, the image display drive device 100 can include a detection circuit 111 and a data superposition circuit 112. For example, concrete structures and configurations of the detection circuit 111 and the data superposition circuit 112 can be chosen according to specific implementation demands, and no limitations will be given here in this respect.

Figure 2:
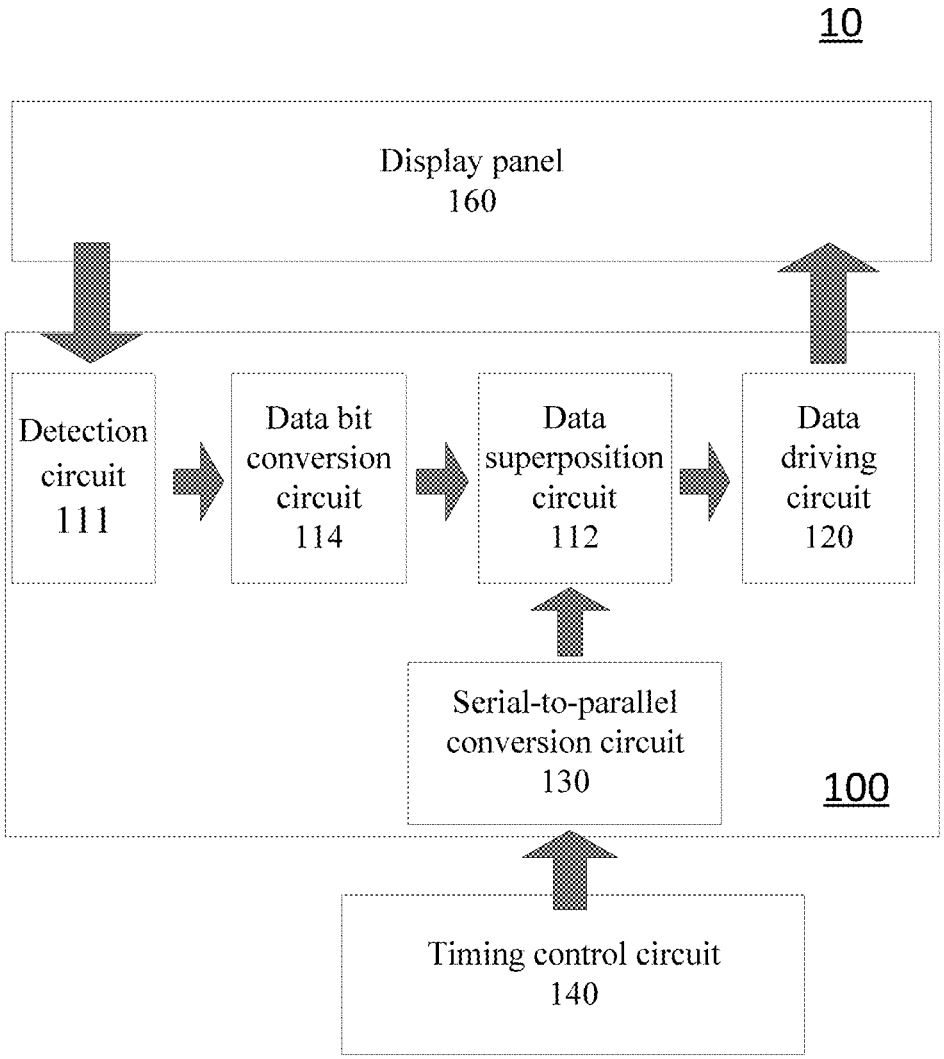
FIG. 2 is an exemplary block diagram of a display device including the image display drive device provided by the first embodiment of the present disclosure.

The present embodiment further provides a display device 10 including the image display drive device 100 provided by the first embodiment of the present embodiment. For example, FIG. 2 illustrates an exemplary block diagram of the above-mentioned the display device 10. For example, as illustrated in FIG. 2, the display device 10 can further include a display panel 160 electrically connected to the image display drive device 100, and the above-mentioned the display panel 160, for example, can be an AMOLED display panel. For example, the display panel 160 is configured to be able to detect an electrical compensation data signal, and the detected electrical compensation data signal, for example, can be provided to the detection circuit 111 of the image display drive device 100. For example, the display device 10 can further include a timing control circuit 140, the timing control circuit 140 can be configured to provide an initial driving data signal, which is used for the display panel 160, to the image display drive device 100, and the timing control circuit 140 can be further configured to provide clock signals, control signals, and the like. For example, concrete structures of the timing control circuit 140 can refer to conventional technologies, and no further descriptions will be given here.

For example, the detection circuit 111 can be configured to obtain the electrical compensation data signal of the display panel 160. For example, the detection circuit 111 can be configured to obtain a detection electrical signal of the display panel 160, and to obtain the electrical compensation data signal of the display panel 160 based on the detection electrical signal. For example, the value of the electrical compensation data signal can be equal to the value of the detection electrical signal.

Figure 9A:
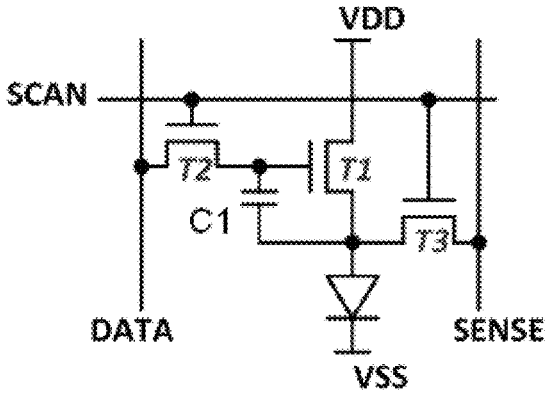
FIG. 9A is a 3T1C type external compensation pixel circuit.
Figure 9B:
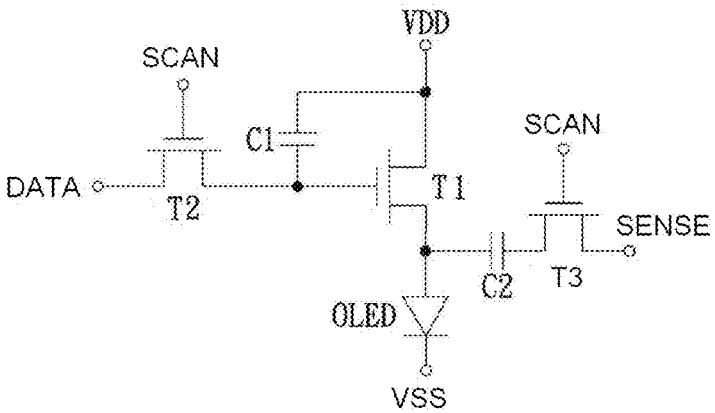
FIG. 9B is a 3T2C type external compensation pixel circuit.

For example, the detection electrical signal can be voltage signals, or can be electrical current signals. For example, a pixel circuit of the display panel 160 can include an external compensation pixel circuit, and the external compensation pixel circuit can be configured to collect current signals or voltage signals. For example, FIG. 9A illustrates a 3T1C type external compensation pixel circuit. The 3T1C (i.e., three transistors and one capacitor) type external compensation pixel circuit further includes a sense line (SENSE) and a sensing transistor T3 on the basis of a conventional 2T1C type pixel circuit (including a driving transistor T1, a switching transistor T2, a storage capacitor C1, a scan line SCAN, a data line DATA, and voltage terminals VDD and VSS), and therefore, the characteristics of the driving transistor T1 or an OLED can be collected and outputted to the detection circuit via sensed current signals or voltage signals. Alternatively, for example, FIG. 9B illustrates another 3T2C type external compensation pixel circuit. The 3T2C type compensation pixel circuit further includes a sense line (SENSE), a sensing transistor T3 and a storage capacitor C2 on the basis of the conventional 2T1C type pixel circuit, and therefore, the characteristics of the driving transistor T1 or the OLED can be collected and outputted to the detection circuit via sensed voltage signals. The above-mentioned method to collect the detection electrical signal is only an example, and the embodiments of the present disclosure is not limited to the specific compensation pixel circuit of the display panel as illustrated, and the compensation pixel circuits in other structures also can be adopted according to implementation demands.

For example, in the case that the detection electrical signal is a voltage signal, the detection circuit 111 can include a voltage sampling circuit; for another example, in the case that the detection electrical signal is an electrical current signal, the detection circuit 111 can include a current sampling circuit. For example, concrete circuit structures of the voltage sampling circuit and/or the current sampling circuit can refer to those of conventional voltage sampling circuits and/or the current sampling circuits, and no further descriptions will be given here.

For example, the detection circuit 111 can conduct the sampling with respect to the display panel 160 before the display panel 160 displays each frame of image, that is, each display period of the display panel 160 include a detection stage and a display stage, the detection circuit 111 can conduct the sampling with respect to electrical signals of the display panel 160 during the detection stage, and apply signals, which are obtained through the sampling, into the compensation of driving data signals during the display stage of present period. For another example, according to specific implementation demands, the detection circuit 111 also can firstly detect the electrical signals of the display panel 160 in the last display period so as to obtain the electrical compensation data signal of the display panel 160, and apply the obtained electrical compensation data signal into the compensation in the next display period. For example, for the image display drive device 100 provided by the first embodiment, because each display period includes the detection stage, real-time compensation can be realized, and therefore, compensation effects can be improved.

For example, the detection circuit 111 can conduct the sampling sequentially with respect to the electrical signals of the pixels of the display panel 160 in the detection stage, and therefore, the detection electrical signal and the electrical compensation data signal can be obtained for each of the pixels, and thus the uniformity of the display brightness of the display panel 160 and the compensation effect can be improved; for another example, according to specific implementation demands, the display panel 160 can include a plurality of display areas, and each of the display areas can include a plurality of display pixels (for example, each of the display areas can include five columns of pixels), the detection circuit 111 also can conduct the sampling sequentially with respect to the electrical signals of each of the display areas of the display panel 160, and therefore the number of times for sampling and the time required for sampling can be reduced, and thus the time of the detection stage is reduced and the power consumption caused by detection is decreased.

For example, the detection circuit 111 can further include an analog-to-digital conversion circuit, and the analog-to-digital conversion circuit can be configured to convert analog signals (for example, the detection electrical signal) obtained by the detection circuit 111 into digital signals, in this case, the data superposition circuit 112 can obtain a compensated driving data signal through superposing the digital signals, and therefore the system complexity can be reduced.

For example, the data superposition circuit 112 can be configured to obtain the compensated driving data signal through superposing the electrical compensation data signal obtained by the detection circuit 111 and the initial driving data signal provided by the timing control circuit 140 of the display panel 160. For example, the data superposition circuit 112 can include a computing element, for example, an arithmetic-logic unit (ALU). For example, according to specific implementation demands, the arithmetic-logic unit can include an adder, a subtractor and at least one of the computing elements to perform the required logic operations, but the embodiments of the present disclosure is not limited to this case. For example, the compensated driving data signal can be provided to the display panel 160, so as to drive the display panel 160 to display images, and therefore, the uniformity of the display brightness of the display panel 160 can be improved.

The electrical compensation data signal obtained by the detection circuit 111 can be positive, and also can be negative, and therefore the value of the initial driving data signal can be increased or decreased, such that the compensated driving data signal can be obtained. For example, the calculation by the data superposition circuit 112 to obtain the compensated driving data signal can be conducted with respected to pixels; for example, the data corresponding to a frame of image can be processed each time, or the data corresponding to a row or more rows of pixels can be processed each time.

For example, the image display drive device 100 provided by the first embodiment include the following functions or operations: obtaining the detection electrical signal of the display panel 160; obtaining the electrical compensation data signal of the display panel 160 based on the detection electrical signal; and obtaining the compensated driving data signal through superposing the electrical compensation data signal and the initial driving data signal. Because all of the above-mentioned functions or operations can be realized in the above-mentioned image display drive device 100 without the necessity of adopting the timing control circuit 140, the data exchanging amount between the image display drive device 100 and the timing control circuit 140 can be reduced relatively, and therefore, the electrical compensation function can be entirely integrated in the image display drive device 100, and the integration level and the response speed of the image display drive device 100 can be improved.

For example, the image display drive device 100 can further include a data bit conversion circuit 114 when required. For example, the data bit conversion circuit 114 can convert the data bit length of the detection electrical signal to match the data bit length of the initial driving data signal. For example, in the case that the data bit length of the initial driving data signal is 6 bits and the data bit length of the detection electrical signal is 8 bits, the data bit conversion circuit 114 can convert the data bit length of the detection electrical signal into 6 bits to reduce redundancy. For example, the conversion method includes linear or nonlinear interpolation conversion, shift conversion, or the like. For example, the function of the data bit conversion circuit 114 provided by the present embodiment is not limited to convert the data bit length of the detection electrical signal into a value that is the same as the data bit length of the initial driving data signal. For example, the data bit conversion circuit 114 also can convert the data bit length of the detection electrical signal so as to allow the data bit length of the detection electrical signal after conversion is greater than the data bit length of the initial driving data signal and smaller than the data bit length of the detection electrical signal before conversion. For example, concrete structures of the data bit conversion circuit 114 can refer to conventional technologies, and no further descriptions will be given here.

For example, the image display drive device 100 can further include a serial-to-parallel conversion circuit 130. For example, the serial-to-parallel conversion circuit 130 can convert the initial driving data signal provided by the timing control circuit 140 from serial format to parallel format, and provide the initial driving data signal in parallel format to the data superposition circuit 112. For example, concrete structures of the serial-to-parallel conversion circuit 130 can refer to conventional technologies, and no further descriptions will be given here.

Figure 3:
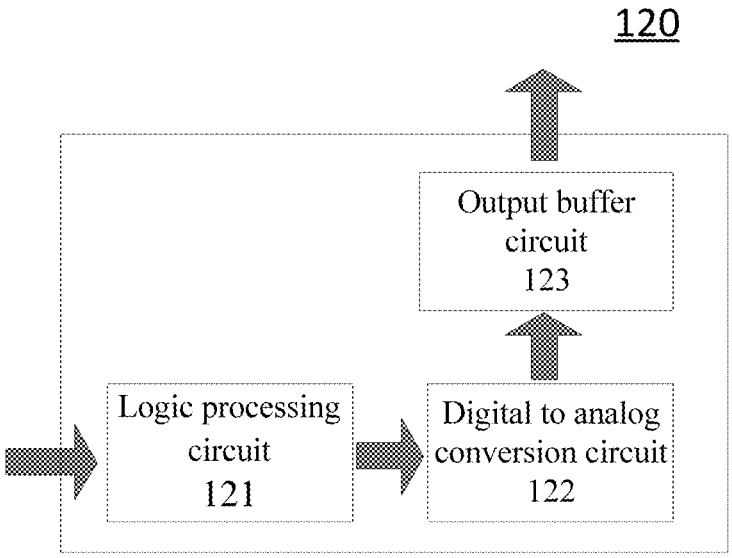
FIG. 3 is an exemplary block diagram of a data driving circuit provided by the first embodiment of the present disclosure.

For example, the image display drive device 100 can further include a data driving circuit 120. For example, the data driving circuit 120 is configured to convert the compensated driving data signal of the display panel 160 into an analog signal suitable to drive the display panel 160. For example, concrete structures and settings of the data driving circuit 120 can be chosen according to specific implementation demands, and no limitations will be given in the embodiments of the present disclosure in this respect. For example, as illustrated in FIG. 3, the data driving circuit 120 can include a logic processing circuit 121, a digital to analog conversion circuit 122 and an output buffer circuit 123. For example, the logic processing circuit 121 can covert the compensated driving data signal into, for example, digital signals in rows through operations such as data storage, data conversion or the like. Therefore, the digital signals in rows can be provided to the digital to analog conversion circuit 122, and in this way, the digital to analog conversion circuit 122 can simultaneously provide, for example, an entire row of analog signals to the display panel 160. For example, concrete structures of the logic processing circuit 121 can refer to conventional technologies, and no further descriptions will be given here.

For example, the digital to analog conversion circuit 122 can convert the digital signal outputted by the logic processing circuit 121 into analog signals, that is, convert the digital signal into voltage signals with corresponding grey scale. For example, the analog signals outputted by the digital to analog conversion circuit 122 can provide to the output buffer circuit 123. For example, concrete structures of the digital to analog conversion circuit 122 can refer to conventional technologies, and no further descriptions will be given here.

For example, the output buffer circuit 123 is configured to amplify the analog signals outputted by the digital to analog conversion circuit 122, so as to be able to drive larger loads (for example, the display panel 160). For example, according to specific implementation demands, the output buffer circuit 123 can include an operational amplifier or other functional devices. For example, concrete structures of the operational amplifier can refer to conventional technologies, and no further descriptions will be given here.

For example, in the present disclosure, all the functions or operations can be realized in the image display drive device without the necessity of adopting the timing control circuit: obtaining the detection electrical signal of the display panel; obtaining the electrical compensation data signal of the display panel based on the detection electrical signal; and obtaining the compensated driving data signal through superposing the electrical compensation data signal and the initial driving data signal. Therefore, the data exchanging amount between the image display drive device and the timing control circuit outside the image display drive device can be reduced relatively, and therefore, the electrical compensation function can be entirely integrated in the image display drive device, and the integration level and the response speed of the image display drive device can be improved. For example, because every display period includes the detection stage, real-time compensation can be realized, and therefore compensation effects can be improved.

Second Embodiment

Figure 4A:
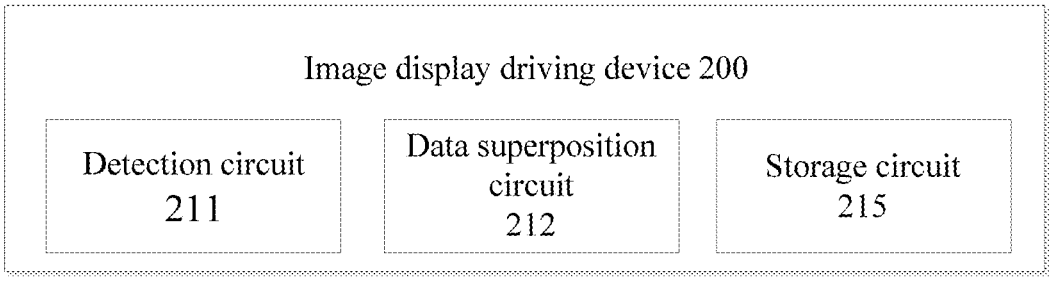
FIG. 4A is an exemplary block diagram of an image display drive device provided by a second embodiment of the present disclosure.
Figure 4B:
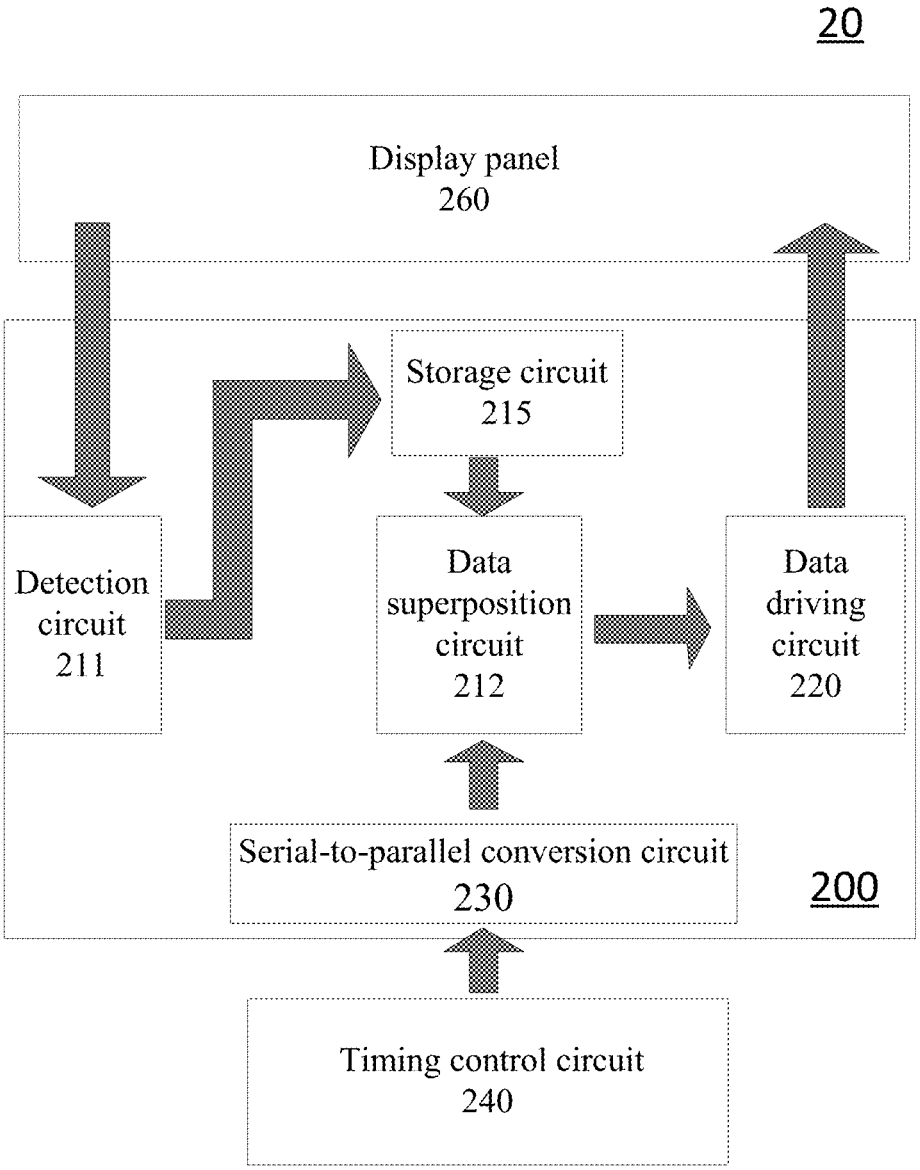
FIG. 4B is an exemplary block diagram of a display device including the image display drive device provided by the second embodiment of the present disclosure.

The present embodiment provides an image display drive device 200 and a display device 20 including the image display drive device 200 provided by the present embodiment. For example, the image display drive device 200 can be implemented as a drive chip to drive a display panel. For example, FIG. 4A illustrates an exemplary block diagram of the image display drive device 200 provided by the second embodiment of the present disclosure, and FIG. 4B is an exemplary block diagram of a display device 20 including the image display drive device 200 provided by the second embodiment of the present disclosure. For example, as illustrated in FIG. 4A, the image display drive device 200 can include a detection circuit 211, a storage circuit 215 and a data superposition circuit 212. For example, concrete circuit structures and settings of the detection circuit 211 and the data superposition circuit 212 can refer to the first embodiment, and no further descriptions will be given here for repeated contents For example, as illustrated in FIG. 4B, compare with the image display drive device 200 and the display device 20 provided by the first embodiment, the image display drive device 200 provided by the second embodiment can further include a storage circuit 215. For example, the storage circuit 215 can be configured to store a detection electrical signal (for example, an electrical compensation data signal) obtained by the detection circuit 211, and to provide the detection electrical signal to the data superposition circuit 212. For example, the storage circuit 215 can include a register, and can also be a semiconductor storage device (for example, a dynamic random access device or static random storage device, or the like), but the embodiments of the present disclosure are not limited to this case.

For example, for the image display drive device 200 and the display device 20 provided by the present embodiment, the detection circuit 211 can conduct sampling with respect to the display panel 260 only in the start-up stage of the display device 20; then, the detection electrical signal (for example, the electrical compensation data signal) stored by the storage circuit 215 can be provided to the data superposition circuit 212 during each display period. Therefore, the data superposition circuit 212 can superpose the electrical compensation data signal, which is provided by the storage circuit 215, and the initial driving data signal, which is provided by the timing control circuit 240 of the display device 20, and can obtain the compensated driving data signal, and thus the electrical compensation of the display panel 260 can be realized and the uniformity of the display brightness of the display panel 260 can be improved.

For example, the image display drive device 200 can further include a data bit conversion circuit (not illustrated in FIG. 4B) to reduce redundancy. For example, settings of the data bit conversion circuit can be chosen according to specific implementation demands, and no limitations will be given in the embodiments of the present disclosure in this respect. For example, the data bit conversion circuit can be electrically connected to the detection circuit 211 and the storage circuit 215, and is configured to convert the data bit length of the detection electrical signal outputted by the detection circuit 211 to match the data bit length of the initial driving data signal, and is further configured to store the detection electrical signal after conversion into the storage circuit 215. For another example, the data bit conversion circuit can also electrically connect to the storage circuit 215 and the data superposition circuit 212, and can be configured to convert the data bit length of the detection electrical signal provided by the storage circuit 215 to match the data bit length of the initial driving data signal, and further configured to provide the detection electrical signal after conversion to the data superposition circuit 212. For further another example, the image display drive device 200 can further include a second data bit conversion circuit (not illustrated in FIG. 4B); in this case, the data bit conversion circuit can be electrically connected to the detection circuit 211 and the storage circuit 215 and can be configured to convert the data bit length of the detection electrical signal outputted by the detection circuit 211 from X bits into Y bits and to store the detection electrical signal, with the data bit length being equal to Y bits, into the storage circuit 215; the second data bit conversion circuit can be electrically connected to the storage circuit 215 and the data superposition circuit 212, and is configured to convert the data bit length of the detection electrical signal provided by the storage circuit 215 from Y bits into Z bits, and is further configured to provide the detection electrical signal, with the data bit length being equal to Z bits, to the data superposition circuit 212. For example, according to specific implementation demands, X can be greater than Y, Y can be greater than Z, and the data bit length of the initial driving data signal can be smaller than or equal to Z bits.

For example, the image display drive device 200 provided by the present embodiment can further include a serial-to-parallel conversion circuit 230 and a data driving circuit 220, and the detection circuit 211 provided by the present embodiment can further include an analog-to-digital conversion circuit (not illustrated in FIG. 4B). For example, concrete circuit structures and related descriptions of the serial-to-parallel conversion circuit 230, the data driving circuit 220 and the analog-to-digital conversion circuit can refer to the first embodiment, and no further descriptions will be given here.

For example, in the present embodiment, because the electrical compensation function are entirely integrated in the image display drive device, the integration level and the response speed of the image display drive device can be improved; also, because the sampling with respect to the display panel can be conducted only in the start-up stage of the display device, the detection time and the power consumption caused by detection can be minimized.

Third Embodiment

Figure 5:
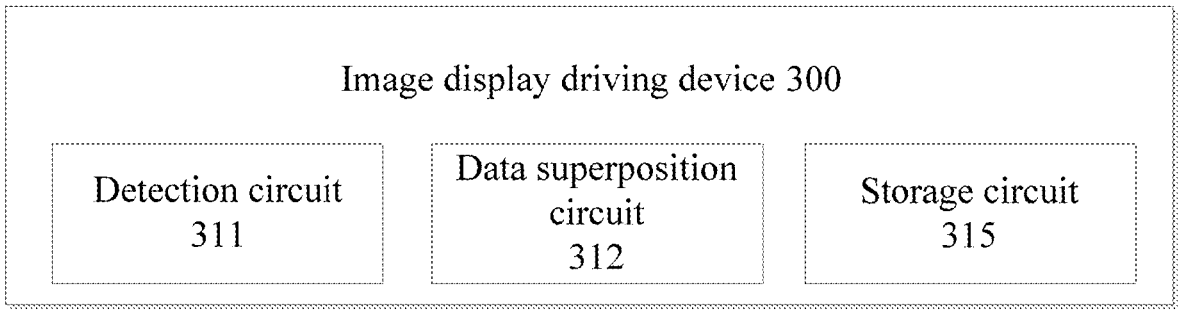
FIG. 5 is an exemplary block diagram of an image display drive device provided by a third embodiment of the present disclosure.
Figure 6:
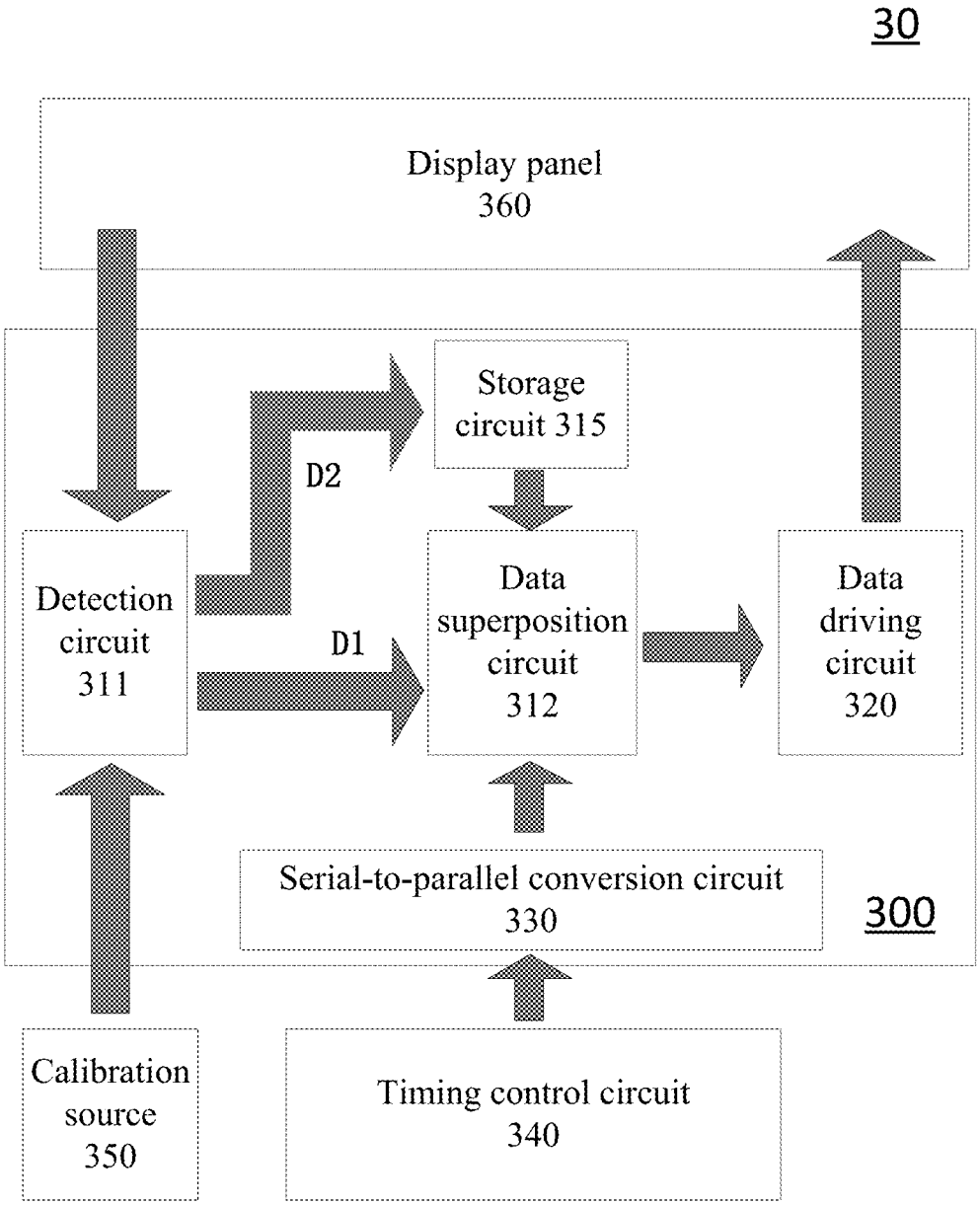
FIG. 6 is an exemplary block diagram of a display device including the image display drive device provided by the third embodiment of the present disclosure.

The present embodiment provides an image display drive device 300 and a display device 30 including the image display drive device 300 provided by the present embodiment. For example, the image display drive device 300 can be implemented as a drive chip to drive a display panel. For example, FIG. 5 illustrates an exemplary block diagram of the image display drive device 300 provided by the third embodiment of the present disclosure, and FIG. 6 is an exemplary block diagram of a display device 30 including the image display drive device 300 provided by the third embodiment of the present disclosure. For example, as illustrated in FIG. 5, the image display drive device 300 can include a detection circuit 311, a storage circuit 315 and a data superposition circuit 312. For example, as illustrated in FIG. 6, the display device 30 can include a display panel 360, a timing control circuit 340, a calibration source 350 and the above-mentioned image display drive device 300.

For example, the calibration source 350 can be configured to be electrically connected to the image display drive device 300, and to provide a calibration base electrical signal D2 to the image display drive device 300 (for example, provide to the detection circuit 311 of the image display drive device 300) in the case that the detection circuit 311 is further configured to obtain the calibration base electrical signal D2. For example, the calibration source 350 can include a constant voltage source or a constant current source. For example, the calibration source 350 can be provided on a PCB board (i.e., a printed circuit board) when required, so as to increase the accuracy of the calibration base electrical signal D2, but the present embodiment is not limited to this case. For example, concrete structures and settings of the calibration source 350 can be chosen according to specific implementation demands, and no limitations will be given here in this respect.

For example, compared with the detection circuit 111 provided by the first embodiment, the detection circuit 311 provided by the present embodiment can be further configured to obtain the calibration base electrical signal D2. For example, the deviation value (i.e., a calibration deviation electrical signal) of the detection electrical signal D1, obtained by the detection circuit 311, with respect to the electrical compensation data signal can be obtained based on the calibration base electrical signal D2. For example, the present embodiment can obtain the calibration base electrical signal D2 through detecting electrical signals (for example, current signals or voltage signals) provided by the calibration source 350 with the detection circuit 311.

For example, the detection circuit 311 can detect the electrical signals provided by the calibration source 350 with respect to each pixel, so as to obtain the calibration base electrical signal D2 corresponding to each pixel. For example, the calibration source 350 can be electrically connected to corresponding pixel of the display panel 360 when detecting the electrical signals provided by the calibration source 350 with the detection circuit 311, so as to obtain the calibration base electrical signal D2 corresponding to each display pixel (for example, parasitic parameters caused by wires and internal circuits of display pixels) of the display panel 360. For another example, according to specific implementation demands, the display panel 360 can include a plurality of display areas, and each of the display areas can include a plurality of display pixels (for example, each of the display areas can include five columns of pixels); the detection circuit 311 also can conduct sampling to the electrical signals outputted by the calibration source 350 sequentially with respect to each of the display areas of the display panel 360. Therefore the number of times of sampling and the time required for sampling can be reduced, and thus the time of the detection stage is reduced and the power consumption caused by detection is decreased.

For example, in the present embodiment, the detection circuit 311 can be configured to obtain the electrical compensation data signal of the display panel 360 based on the calibration base electrical signal D2 and the detection electrical signal D1, which are obtained by the detection circuit 311. For example, in the case that the voltage value outputted by the calibration source 350 is 3 V, the voltage values of the calibration base electrical signals D2, which correspond to two pixels of the display panel 360, detected by the detection circuit 311 are 2.5V and 2V respectively, the voltage values of the detection electrical signals D1, which correspond to the two pixels of the display panel 360, detected by the detection circuit 311 are 4V and 3V respectively, the voltage values, which are obtained based on the above-mentioned data, of the calibration deviation signal (i.e., the deviation value of the detection electrical signal D1 with respect to the electrical compensation data signal) of the above-mentioned two pixels are 0.5V and 1V respectively, and the voltage values, which are 4.5V and 4V respectively, of the electrical compensation data signal of the above-mentioned two pixels can also be obtained. For example, for the sake of clarity, all the voltage values of the calibration base electrical signals D2 as illustrated in the above-mentioned examples are smaller than the voltage values outputted by the calibration source 350, but the present embodiment is not limited to this case, the voltage values of the calibration base electrical signal D2, for example, can also be greater than or equal to the voltage values outputted by the calibration source 350.

For example, in the present embodiment, because the detection circuit 311 not only detects the detection electrical signal D1 of the display panel 360, but also detects the calibration base electrical signal D2, the electrical compensation data signal, which is obtained based on the calibration base electrical signal D2 and the detection electrical signal D1, of the display panel 360 is closer to the compensation value required by the display panel 360, and therefore, the compensation effect can be improved.

For example, considering that the value of the calibration base electrical signal D2 is relatively fixed, the calibration base electrical signal D2 obtained by the detection circuit 311 can be stored in the storage circuit 315, and therefore, the detection circuit 311 can conduct sampling with respect to the electrical signals outputted by the calibration source 350 only in the start-up stage of the display device 30. For example, the value of the electrical signals outputted by the calibration source 350 also can be stored in the storage circuit 315 in advance, and therefore, the calibration deviation electrical signal can be provided to the data superposition circuit 312 in each display period. For example, the compensated driving data signal can be obtained by the data superposition circuit 312 in each display period through superposing the electrical compensation data signal (i.e., the calibration deviation electrical signal provided by the storage circuit 315 and the detection electrical signal D1 provided by the detection circuit 311) and the initial driving data signal provided by the timing control circuit 340 of the display panel 360. For example, in the present embodiment, the value of the electrical signals outputted by the calibration source 350 is not limited to be stored in the storage circuit 315, and the value of the electrical signals outputted by the calibration source 350 can also be stored in the data superposition circuit 312 in advance according to specific implementation demands.

For example, the image display drive device 300 provided by the present embodiment can further include at least one of a data bit conversion circuit (not illustrated in FIG. 6), a serial-to-parallel conversion circuit 330 and a data driving circuit 320, and the detection circuit 311 provided by the present embodiment can further include an analog-to-digital conversion circuit (not illustrated in FIG. 6). For example, concrete circuit structures and related descriptions of the data bit conversion circuit, the serial-to-parallel conversion circuit 330, the data driving circuit 320 and the analog-to-digital conversion circuit can refer to the first embodiment and the second embodiment, and no further descriptions will be given here.

For example, in the present embodiment, because the electrical compensation function are entirely integrated in the image display drive device, the integration level and the response speed of the image display drive device can be improved; also, because the detection circuit further detects the calibration base electrical signal, the compensation effect can be improved; further, because the sampling with respect to the calibration source can be conducted only when starting the display device, the detection time and the power consumption caused by detection can be reduced.

Fourth Embodiment

Figure 7A:
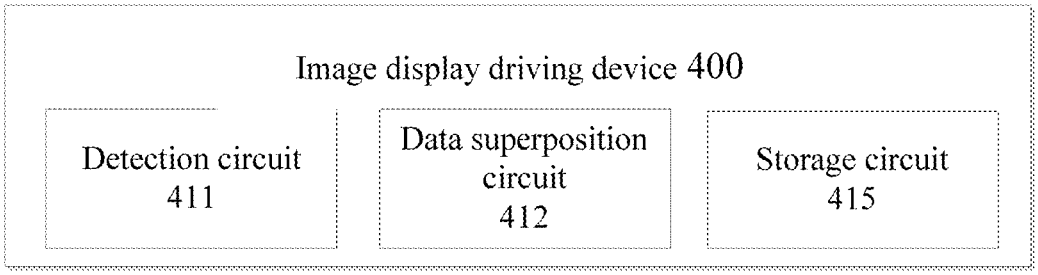
FIG. 7A is an exemplary block diagram of an image display drive device provided by a fourth embodiment of the present disclosure.
Figure 7B:
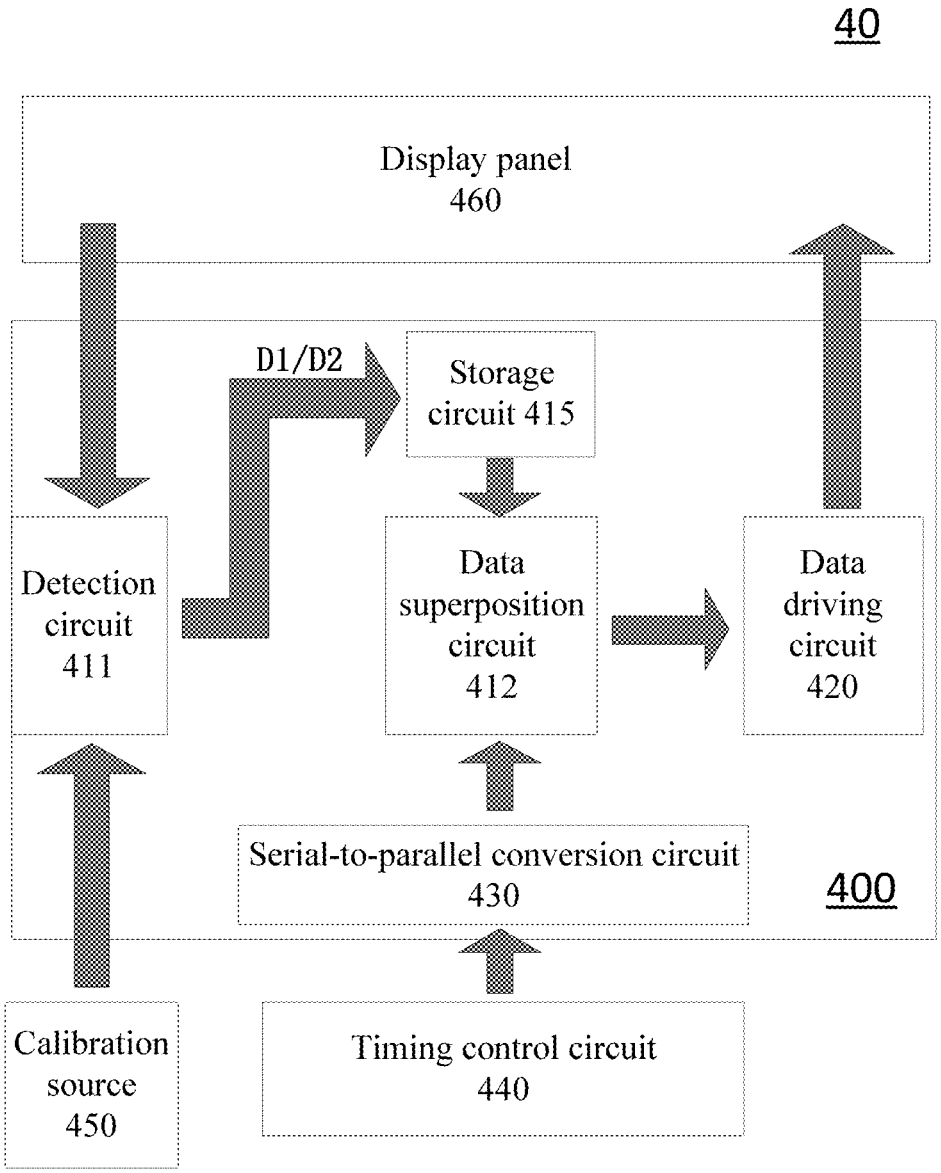
FIG. 7B is an exemplary block diagram of a display device including the image display drive device provided by the fourth embodiment of the present disclosure.

The present embodiment provides an image display drive device 400 and a display device 40 including the image display drive device 400 provided by the present embodiment. For example, the image display drive device 400 can be implemented as a drive chip to drive a display panel. For example, FIG. 7A illustrates an exemplary block diagram of an image display drive device 400 provided by the fourth embodiment of the present disclosure, and FIG. 7B is an exemplary block diagram of a display device 40 including the image display drive device 400 provided by the fourth embodiment of the present disclosure. For example, as illustrated in FIG. 7A, the image display drive device 400 can include a detection circuit 411, a storage circuit 415 and a data superposition circuit 412. For example, as illustrated in FIG. 7B, the display device 40 can include a display panel 460, a timing control circuit 440, a calibration source 450 and the above-mentioned image display drive device 400.

For example, the image display drive device 400 provided by the present embodiment is similar to the image display drive device 300 provided by the third embodiment, for the sake of clarity, the fourth embodiment only describes the differences between the fourth embodiment and the third embodiment, and no further descriptions will be given here for the repeated contents with respect to the third embodiment.

For example, compared with the image display drive device 300 provided by the third embodiment, both the detection electrical signal D1 and the calibration base electrical signal D2, which are obtained by the image display drive device 400 provided by fourth embodiment, can be stored in the storage circuit 415, and can be provided to the data superposition circuit 412 in each display period. Therefore, the image display drive device 400 and the display device 40 provided by the present embodiment can conduct sampling with respect to the display panel 460 and the calibration source 450 with the detection circuit 411 (for example, the sampling is firstly conducted with respect to the calibration source 450, and then with respect to the display panel 460, but the present embodiment is not limited to this case) only when starting the display device 40, and thus the detection time and the power consumption caused by detection can be further reduced.

For example, the image display drive device 400 provided by the present embodiment can further include at least one of a data bit conversion circuit (not illustrated in FIG. 7B), a serial-to-parallel conversion circuit 430 and a data driving circuit 420, and the detection circuit 411 provided by the present embodiment can further include an analog-to-digital conversion circuit (not illustrated in FIG. 7B). For example, concrete circuit structures and related descriptions of the data bit conversion circuit, the serial-to-parallel conversion circuit 430, the data driving circuit 420 and the analog-to-digital conversion circuit can refer to the first embodiment and the second embodiment, and no further descriptions will be given here.

For example, in the present embodiment, because the electrical compensation function are entirely integrated in the image display drive device, the integration level and the response speed of the image display drive device can be improved; also, because the detection circuit further detects the calibration base electrical signal, the compensation effect can be improved; further, because the sampling with respect to the calibration source and the display panel can be conducted only in the start-up stage of the display device, the detection time and the power consumption caused by detection can be further reduced.

Fifth Embodiment

Figure 8:
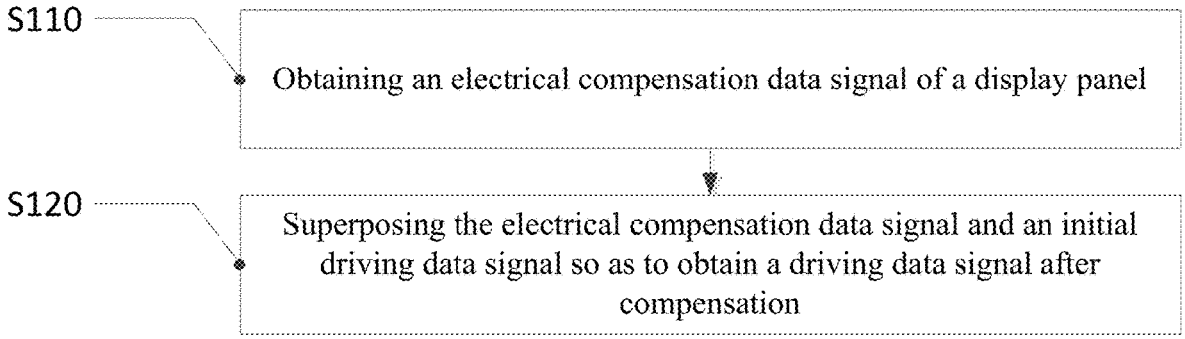
FIG. 8 is an exemplary flow chart of an electrical compensation method provided by a fifth embodiment of the present disclosure.

The present embodiment provides an electrical compensation method. For example, the electrical compensation method can be used for compensation of a display panel, so as to improve the uniformity of the display brightness of the display panel. For example, as illustrated in FIG. 8, the electrical compensation method can include the following operations:

Step S110: obtaining an electrical compensation data signal of a display panel;

Step S120: superposing the electrical compensation data signal and an initial driving data signal so as to obtain a compensated driving data signal.

For example, the electrical compensation method is described in detail in the following by taken the image display drive device and the display device as illustrated in the third embodiment as an example, but the electrical compensation method provided by the present embodiment is not limited to this case.

For example, the step S110 can include: obtaining a calibration deviation electrical signal and a detection electrical signal of the display panel, and obtaining the electrical compensation data signal of the display panel based on the calibration deviation electrical signal and the detection electrical signal. For example, specific methods to obtain the calibration deviation electrical signal and the detection electrical signal of the display panel, and specific methods to obtain the electrical compensation data signal of the display panel based on the calibration deviation electrical signal and the detection electrical signal can refer to the third embodiment, and no further descriptions will be given here.

For example, in the step S120, specific methods to superpose the electrical compensation data signal and the initial driving data signal so as to obtain the compensated driving data signal can refer to the third embodiment, and no further descriptions will be given here.

For example, the electrical compensation method provided by the present embodiment can further include: storing the calibration base electrical signal, and accessing the calibration base electrical signal when superposing the electrical compensation data signal and the initial driving data signal. For example, specific methods to store the calibration base electrical signal and to access the calibration base electrical signal can refer to the third embodiment, and no further descriptions will be given here.

For example, the electrical compensation method provided by the present embodiment can further include: converting the calibration deviation electrical signal and the detection electrical signal into digital signals, and obtaining the compensated driving data signal through superposing the electrical compensation data signal, which is obtained based on the calibration base electrical signal and the detection electrical signal, and the initial driving data signal. For example, specific methods to obtain the compensated driving data signal through superposing the electrical compensation data signal and the initial driving data signal can refer to the third embodiment, and no further descriptions will be given here.

For example, in the present embodiment, because the electrical compensation of the display panel can be realized without the necessity of adopting the timing control circuit, the data exchanging amount can be reduced and the compensation speed can be increased; also, because the electrical compensation method provided by the present embodiment further detects the calibration base electrical signal, the compensation effect of the display panel can be improved; further, because the sampling with respect to the calibration source can be conducted only when starting the display panel, the detection time and the power consumption caused by detection can be reduced.

It is apparent that the embodiments of the present disclosure can be modified, changed and combined by those skilled in the art without departure from the spirit and scope of the disclosure, if the above modification, change and combination of the presented disclosure belongs to the scope of the claims of the presented disclosure and its equivalent technologies, the presented disclosure is intended to include the above modifications.

What are described above is related to the illustrative embodiments of the disclosure only and not limitative to the scope of the disclosure; the scopes of the disclosure are defined by the accompanying claims.

What is claimed is:

1. An image display drive device, comprising:

a detection circuit, configured to obtain an electrical compensation data signal of a display panel; and a data superposition circuit, configured to superpose the electrical compensation data signal and an initial driving data signal so as to obtain a compensated driving data signal;

wherein the detection circuit is configured to obtain a calibration base electrical signal and a detection electrical signal of the display panel and to obtain the electrical compensation data signal of the display panel based on the calibration base electrical signal and the detection electrical signal.

2. The drive device according to claim 1, wherein the detection circuit comprises a voltage sampling circuit or a current sampling circuit.

3. The drive device according to claim 2, wherein the detection circuit further comprises an analog-to-digital conversion circuit; and the analog-to-digital conversion circuit is configured to convert an analog signal obtained by the detection circuit into a digital signal.

4. The drive device according to claim 2, further comprising a storage circuit, wherein the storage circuit is configured to store at least one of the calibration base electrical signal and the detection electrical signal, and to provide the at least one of the calibration base electrical signal and the detection electrical signal to the data superposition circuit.

5. The drive device according to claim 4, wherein the storage circuit comprises a register.

6. The drive device according to claim 2, further comprising a data bit conversion circuit, wherein the data bit conversion circuit is configured to convert a data bit length of the calibration base electrical signal and a data bit length of the detection electrical signal to match a data bit length of the initial driving data signal.

7. The drive device according to claim 1, further comprising a storage circuit, wherein the storage circuit is configured to store at least one of the calibration base electrical signal and the detection electrical signal, and to provide the at least one of the calibration base electrical signal and the detection electrical signal to the data superposition circuit.

8. The drive device according to claim 7, wherein the storage circuit comprises a register.

9. The drive device according to claim 1, further comprising a data bit conversion circuit, wherein the data bit conversion circuit is configured to convert a data bit length of the calibration base electrical signal and a data bit length of the detection electrical signal to match a data bit length of the initial driving data signal.

10. The drive device according to claim 1, further comprising a data driving circuit, wherein the data driving circuit is configured to convert the compensated driving data signal of the display panel into an analog signal suitable to drive the display panel.

11. A display device, comprising: the drive device according to claim 1 and a display panel electrically connected to the drive device, wherein the electrical compensation data signal of the display panel is configured to be detectable.

12. The display device according to claim 11, further comprising:

a calibration source, configured to be electrically connected to the drive device, and to provide, in a case where the detection circuit is further configured to obtain a calibration base electrical signal, the calibration base electrical signal to the drive device; and a timing control circuit, configured to provide the initial driving data signal of the display panel to the drive device.

13. The display device according to claim 12, wherein the calibration source comprises a constant voltage source or a constant current source.

14. An electrical compensation method, comprising:

obtaining an electrical compensation data signal of a display panel; and superposing the electrical compensation data signal and an initial driving data signal so as to obtain a compensated driving data signal;

wherein the obtaining the electrical compensation data signal of the display panel comprises:

obtaining a calibration base electrical signal and a detection electrical signal of the display panel, and obtaining the electrical compensation data signal of the display panel based on the calibration base electrical signal and the detection electrical signal.

15. The electrical compensation method according to claim 14, further comprising:

storing at least one of the calibration base electrical signal and the detection electrical signal, and accessing the at least one of the calibration base electrical signal and the detection electrical signal when superposing the electrical compensation data signal and the initial driving data signal.

16. The electrical compensation method according to claim 15, further comprising:

converting the calibration base electrical signal and the detection electrical signal into digital signals, and obtaining the compensated driving data signal through superposing the electrical compensation data signal, which is obtained based on the calibration base electrical signal and the detection electrical signal, and the initial driving data signal.

17. The electrical compensation method according to claim 14, further comprising:

converting the calibration base electrical signal and the detection electrical signal into digital signals, and obtaining the compensated driving data signal through superposing the electrical compensation data signal, which is obtained based on the calibration base electrical signal and the detection electrical signal, and the initial driving data signal.

* * * * *